United States Patent [19]

Gerth

[11] 4,423,903

[45] Jan. 3, 1984

[54] HANDLE OPERATED INCLINER CHAIR

[76] Inventor: William V. Gerth, 451 Phillip St., Waterloo, Ontario, Canada

[21] Appl. No.: 258,892

[22] Filed: Apr. 30, 1981

[51] Int. Cl.[3] ..... A47C 1/02

[52] U.S. Cl. ..... 297/89; 297/68; 297/83

[58] Field of Search ..... 297/61, 68, 83, 84, 297/85, 88, 317, 89, 327

[56] References Cited

U.S. PATENT DOCUMENTS

| | | | |
|---|---|---|---|
| 3,357,739 | 12/1967 | Knabusch et al. | 297/84 X |
| 3,433,527 | 3/1969 | Re | 297/85 |
| 3,743,349 | 7/1973 | Crum et al. | 297/85 |
| 4,113,305 | 9/1978 | Hampton | 297/85 X |
| 4,212,494 | 7/1980 | Dabney | 297/84 |
| 4,319,780 | 3/1982 | Rogers, Jr. | 297/85 |
| 4,346,933 | 8/1982 | Jacobs | 297/89 |

*Primary Examiner*—James T. McCall
*Attorney, Agent, or Firm*—K. Maxwell Hill

[57] ABSTRACT

An incliner chair has a combined seat and backrest member moveable from a normal occupant sitting position to an occupant inclining position by means of a mechanism attached to a stationary chair frame, by an occupant-operable handle. The handle causes a rotary element connecting identical mechanisms on either side of the chair to actuate linkages that simultaneously thrust out a footrest member and pull down and forward the rear of the seat part with its attached back while thrusting up and forward the front of the seat. A two link control assembly is provided to control and guide the back from moving backward from its normal position to the inclined position and comprise a control link attached intermediate its length to a toggle plate which is itself pivotably connected to the chair frame upwardly and rearwardly of the axis of the rotary element. The toggle plate is pivotably attached to a primary thrust lever at a point allowing the back control lever to be pivoted intermediate it and the toggle frame pivot point. One end of the back control link is attached to the rear of the seat bottom and the other end is attached to a guide link which is in turn attached to the chair frame, and is the second link in the control assembly.

5 Claims, 2 Drawing Figures

HANDLE OPERATED INCLINER CHAIR

FIELD OF INVENTION

The present invention relates to incliner chair assemblies where a seat portion and a back portion are moveable together upon a fixed chair frame. In particular the invention herein provides a handle operated mechanism allowing an occupant to change a seat and back with associated retractable footrest, from a normal chair position to an inclined position without having any portion of the backrest touch a wall positioned immediately adjacent the chair back when in the normal chair posture.

PRIOR ART

Handle operated chairs that have backs that recline backwards are known and chairs having seats that have forward and downward movements controlled by an occupant manipulating a handle member are also known. Recent developments in incliner and recliner chairs is to have the seat and back fixed together for movement together and the seat and back are reclined together by the occupants' action, while seated, of pulling or pushing on parts of the chair such as stationary armrests. The trade now calls chairs either "incliners" or "recliners" depending upon the action of the occupant to change his position. The difficulty has now arisen that, where a potential user of the chair wishes to change the position from normal after sitting into it, he does not know whether he should push or pull. The confusion thereby caused to the new user of a particular chair of the many similarly appearing chairs available, has created a demand for the return of a handle operated chair which can be more positively manipulated.

DISADVANTAGES OF THE PRIOR ART

The commonly known handle operated incliner chairs cannot be inclined from the normal chair posture when backed close to a wall without the back striking the wall since the mechanisms now used move the chair downward and also partly backward. It is also known that the retractable footrest of the known recliners do not allow a child or small person to sit or push on the footrest when occupied by the legs and feet of a chair occupant without causing the mechanism to trip and retract the footrest thereby disturbing the reclining occupant.

OBJECTS OF THE INVENTION

The principal object of the present invention is to provide a mechanism for an incliner chair assembly that is easily manipulated into one of the two positions possible by an occupant moving a handle forward or backward thereby to change the combined backrest and seat from either the normal position or the inclined position, with the back capable of moving only downward and forward for the inclined position.

Another object of the invention is to provide a footrest mechanism that is operated simultaneously with the movement of the seat and back to extend the footrest outwardly and locked in a leg support position capable of supporting the weight or push of at most about 55 pounds before the lock is released and the mechanism tripped to retract the footrest and force the handle back to disturb the occupant and the inclination of the chair and back.

A further object of the invention is to provide a rear guide and swing link combination of lever assembly causing the back of the chair to move downward and forward in an arcuate path without any rearward movement when the handle is operated to incline the seat and back, thereby allowing the chair to be permanently positioned against a back wall, if desired, for either normal or reclining usage.

SUMMARY OF THE INVENTION

The invention herein described discloses an incliner chair assembly having a combined seat and back member fixed to a stationary chair frame base through a mechanism for actuating relative movement with the base between a substantially normal position of the seat and back and retracted position of a footrest member; and a partially and relatively inclined position of the seat and back and extended portion of the footrest. The mechanism comprises a pair of assembles, one on each side of the chair moveable together by a torsion tube rotary element rotatably fixed to the chair frame and operated by a handle into one or either of the two positions. The seat is fixed to a plate or bar member. The footrest comprises a conctenated tong assembly having forward ends pivotably connected to a footrest plate and control lever bars are pivotably connected at their forward ends to the tong assembly and rearwardly to an assemby control toggle plate attached to the seat frame.

A crank arm is set on a bracket to the rotary member and primary drive links pivotably connect the crank arms to the toggle plates. The toggle plates are pivotably connected to the chair frame upwardly and rearwardly of the axis of rotation of the rotary element. The back control assembly includes back control levers pivotably connected between their ends to the toggle plates intermediate the pivot connection of the primary links and the toggle connection to the chair. The forward ends of the back assembly control levers are connected to the seat plates and the rear ends are connected to swing guide levers. The swing guide levers are attached to the seat frame in pivot mode below the pivot connection of the toggle lever, thereby assuring that the back moves only downward and forward when the seat moves forward on the plates controlled by a short crank and the long primary link. A pair of levers are provided forward of the rotary element and toggle plates to support and guide the forward ends of the seat plates, and are pivotably attached between the frame and the seat plates.

IN THE DRAWINGS

With the foregoing objects in view and such other objects that become apparent from consideration of this disclosure, the present invention consists of the inventive concept which is comprised, embodied and included in the construction, method and combination of parts herein exemplified reference being had to the accompanying drawings in which like reference numerals refer to like parts.

THE PREFERRED EMBODIMENT OF THE INVENTION

Figure 1:
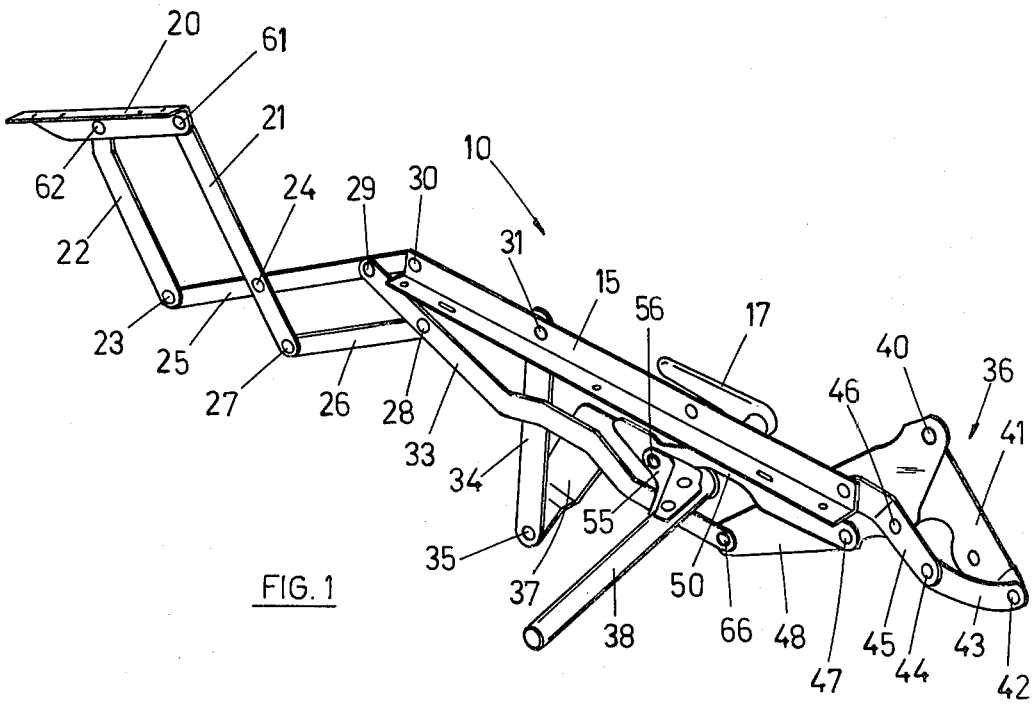
FIG. 1 is a view of one side of the mechanism showing the rotary element torsion bar, in part, directed to the other side, and is in the inclined position with the footrest extended and the handle in the full forward position.
Figure 2:
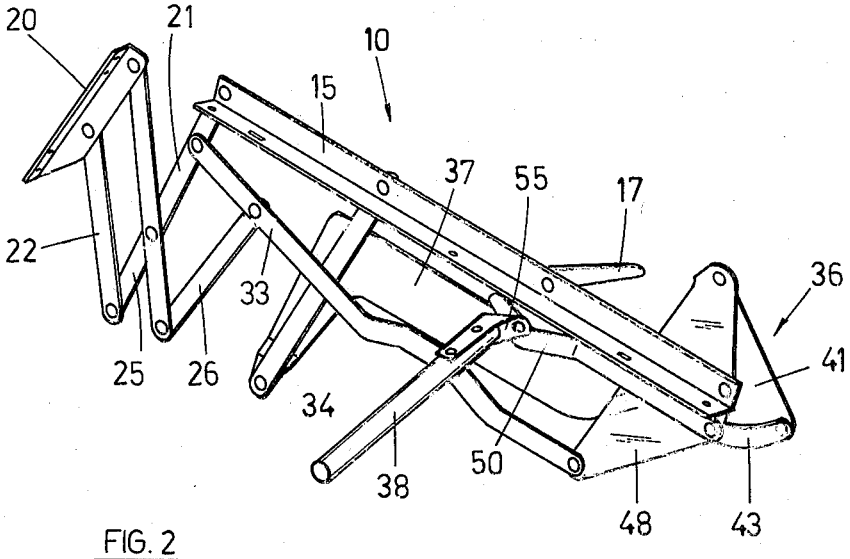
FIG. 2 shows the mechanism of FIG. 1 in the position causing the seat to be in a normal chair position with the footrest retracted.

Numeral 10 in the drawings indicates one of a pair of mechanisms used herein as the assembly to move a seat and back (not shown) of a chair, used as a normal upright chair or convertible to an "incliner" type chair. The seat is attached to a pair of supporting bars or plates 15. For installation to different shaped chairs of different manufacture the mechanisms 10 are attached to a base plate member 37, 41, it being understood that 37,41 is one part with the dog leg rear portion numbered 41. The base plate 37,41 is fixed to the stationary base frame of the chair (not shown). The rearward part of the bars 15 are attached to back control levers 45 which are in turn pivotably attached at 44 to swing guide links 43. Guide links 43 are pivotably attached to the frame and base plate 41 at 42. The back being integrally formed with the seat, is controlled, as is the rear of the seat, by the movement of guide link 43 and control link 45 which govern by their points of attachment and lengths, the degree of arcuate movement downward of the back.

Movement forward and backward of the assembly is controlled by the occupant turning handle 17 which is directly connected to a rotary torsion bar element 38 rotatably mounted in nylon bearings in each side of the stationary base of the chair frame. A bracket member having a short crank arm 55 is fixed to either end of the rotary element 38 through which the rotary motion caused by the movement of the handle is transmitted to the mechanisms 10. The short crank moves a primary link on each mechanism through an arc traced by the handle 17. The crank arms travel through an arc of about 178° and are attached pivotably at 56 to primary link 50 which is, at its rearward end, pivotably attached at 47 to a toggle plate 48 at a point below the pivot attachment 46 of the back control link 45. The toggle plate 48 is pivotably attached to the frame and base plate 37 at point 40 which is rearwardly and upwardly of the ratary axis of said element for rotating the assembly 38.

The back control link 45 is pivotably connected between its ends at 46 to the toggle plate. Forward movement of the handle 17 causes primary link levers 50 to pivot toggle plate 48 forward which in turn causes motion of the seat plates 15 downward and forward by the guiding action of links 45,43 pivoting at 46,42, and folding at 44.

To insure that the footrest remains extended when an ouside force or weight of a child pushing or sitting on the footrest while the chair is occupied, and to thereby provide a slight lock to the chair when inclined, the pivot points of the forward crank and the primary link 56, and the pivot point 47 are substantially in line with the rotary axis of the rotary element 38.

The footrest assembly comprises a concatenated tong assembly 21,22, 25,26 having forward ends thereto pivotably connected at 61,62, to a footrest plate 20. Footrest control lever bars 33 are pivotably connected at their forward ends 28,29, to tong links 26,25 respectively and at the rearward ends to toggle plate 48 at pivot point 66. Tong link 25 is connected to the front of seat bar 15 at pivot point 30 and to forward tong link 22 by pivot 23. Tong link 21 is pivotably connected to tong links 25,26 by pivots 24,27 respectively.

A secondary support lever 34 is pivotably connected at 31 to the seat plate 15 toward the forward end thereof, and is pivotably connected at 35 to the base plate and frame of the chair below the rotary axis and forward leaning in the chair incline position to provide lock support to the footrest and seat and also to give the upward push on the seat during inclination of the seat forward end. Lever 34 both controls and guides the seat plates 15.

The essentially novel back control assembly is designated numeral 36 and comprises the two links 45,43, which are connected to pivot point 46 on the toggle plate intermediate the pivot of primary link 50 at 47 and the upward and backward pivot of the toggle plate 48 on the frame at 40. The illustrated positioning of the guide and control links with relation to the pivot points 40,47, both limits and controls the path of travel of the chair back which is not permitted by the assembly 36 to move backward when the handle causes inclination of the seat.

The primary links 50 are connected to the toggle plate 48 intermediate the pivot connection point of the control levers 33 to the toggle plate and the pivot point connection of the toggle plate to the chair side frame at point 40.

OPERATION OF THE MECHANISM

To operate the novel mechanism disclosed herein, a pair of them are fitted to a suitable base with the rotary element fitted between the pair and into a nylon bearing fixed in each side of the chair frame. A suitable back and seat member is attached to the seat plates. With an occupant seated the handle is thrust forward until it locks in the forward position. Forward movement of the handle causes the crank arms to travel through an arcuate path of about 180° pulling the primary links and connected toggle plates with them. The footrest control arms are pushed forward by the pivoting of the toggle plates about pivot 40 attached to the chair frame. With their forward travel the control arms thrust forward the tong assembly holding up the footrest. Control for the back is provided by the positioning of the control link 45 on a point in the toggle plate intermediate the pivot point of the primary link and the toggle plate and the pivot placing of the toggle plate to the frame, and by having the control link 45 attached itself intermediate its length to the toggle plate while its one end is attached to the seat plate rearward end and its other end is attached to a pivotable swing guide link attached to the frame. With forward thrust of the handle the swing and guide links extend forward pushing the seat forward but the downward movement of the toggle plate pulls the control link and the attached seat downward.

What I claim is:

1. A mechanism, connected to base plates fixed to a chair frame, for actuating the seat, back, and footrest of a chair between; (a) the substantially normal position of the said seat and back and a retracted position of the footrest and; (b) a partially and relatively inclined position of the said seat and back and extended portion of the said footrest, comprising the combination with hand operated rotary elements on one side of said chair actuated by the occupant, of a pair of seat-supporting bars, said footrest comprising a concatenated tong assembly having forward ends thereto pivotably connected to a footrest plate, footrest control lever bars pivotably connected at forward ends thereof to said tong assembly; crank arms connected to said rotary element; rearwardly extending primary links, toggle plates pivotably connected to said base plates rearwardly of the rotary axis of said element; said primary links being pivotably connected at their rear ends to said toggle plates, said control bars being pivotably connected at rear ends thereof to said toggle plates; a back controlling assembly including (a) back controlling levers pivotably connected between their ends to said toggle plates, the forward ends of said levers being pivotably connected to said seatsupporting bars and (b) swing-links pivotably connected at both their forward and rear ends to the rear ends of said levers and said base plates respectively whereby said back is caused upon actuation of said mechanism to move through an arcuate path in which it is limited to downward movement only forwardly from its normal or upright position; and secondary link levers pivotably connected to the sides of said chair and said seat-supporting bars for controlling said bars.

2. The mechanism according to claim 1 in which the points at which said crank arms are pivotably connected to said rotary element and at which said primary links are pivotably connected to said toggle plates are substantially in line with the rotary axis of said element, said pivotable connections being forward and rearward of said pivotable connections respectively when said footrest is extended.

3. The mechanism according to claim 2 in which an angle of less than 180° exists between said points of pivotable connection when said footrest is extended, and wherein said toggle plates are connected at one end thereof to said base plates frame rearwardly and upwardly of the rotary axis of said element.

4. The mechanism according to claim 2 in which the primary links are connected to the toggle plates intermediate the points of connections of the control link levers and the connection of the toggle plate to the said base plates.

5. The mechanism of claim 1 wherein the back control levers are connected to the toggle plates intermediate the connections of the primary links to the toggle plates and the connection of the toggle plates to the base plates thereby insuring that the back moves downward and forward with extension of the footrest.

* * * * *